US010900413B2

(12) United States Patent
Pons

(10) Patent No.: US 10,900,413 B2
(45) Date of Patent: Jan. 26, 2021

(54) INTERNAL COMBUSTION ENGINE

(71) Applicant: Jean Eugène Pons, Capbreton (FR)

(72) Inventor: Jean Eugène Pons, Capbreton (FR)

( * ) Notice: Subject to any disclaimer, the term of this patent is extended or adjusted under 35 U.S.C. 154(b) by 0 days.

(21) Appl. No.: 16/616,040

(22) PCT Filed: May 23, 2017

(86) PCT No.: PCT/FR2017/051267

§ 371 (c)(1),
(2) Date: Nov. 22, 2019

(87) PCT Pub. No.: WO2018/215698

PCT Pub. Date: Nov. 29, 2018

(65) Prior Publication Data

US 2020/0088094 A1 Mar. 19, 2020

(51) Int. Cl.
*F02B 75/32* (2006.01)
*F01B 1/08* (2006.01)
(Continued)

(52) U.S. Cl.
CPC ..... *F02B 75/32* (2013.01); *F01B 1/08* (2013.01); *F01B 7/16* (2013.01); *F01B 9/02* (2013.01);
(Continued)

(58) Field of Classification Search
CPC ..... F01B 1/08; F01B 7/16; F01B 9/02; F02B 75/32; F02B 75/18
See application file for complete search history.

(56) References Cited

U.S. PATENT DOCUMENTS 5,983,845 A * 11/1999 Yanagisawa ..... F01B 9/023 123/197.1
9,435,202 B2 * 9/2016 Rafalski ..... F04B 9/02
(Continued)

FOREIGN PATENT DOCUMENTS

CH 202053 A 12/1938
DE 19602703 A1 2/1997
(Continued)

OTHER PUBLICATIONS

International Search Report corresponding International application PCT/FR2017/051267 dated Sep. 7, 2017, 2 pages.

*Primary Examiner* — Kevin A Lathers
(74) *Attorney, Agent, or Firm* — Cooper Legal Group, LLC; Ronald M. Kachmarik

(57) ABSTRACT

An internal combustion engine including at least two cylinders with parallel longitudinal axes, each cylinder including an opening and a piston capable of moving in translation inside the cylinder, the respective openings of the cylinders facing each other, the pistons being in kinematic relation with a connecting rod-crank mechanism including: a spacer connecting the pistons, suitable for maintaining a fixed spacing between the pistons, the pistons being respectively attached to the arms of the spacer, a crankshaft rotating about an axis, arranged between the openings of the cylinders and between the longitudinal axes of the cylinders, the crankshaft comprising a crank pin, a rocker rotating about the crank pin, at least one connecting rod including a first, small end, rigidly attached to the spacer and a second, big end, rigidly attached to one of the ends of the rocker.

8 Claims, 4 Drawing Sheets

Figure 1:
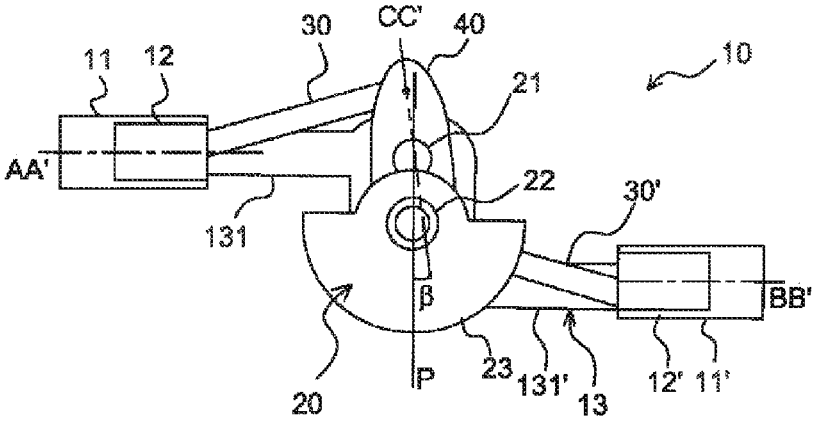

(51) Int. Cl.
*F01B 7/16* (2006.01)
*F01B 9/02* (2006.01)
*F02B 75/18* (2006.01)

(52) U.S. Cl.
CPC ..... *F02B 75/18* (2013.01); *F02B 2075/1816* (2013.01)

(56) References Cited

U.S. PATENT DOCUMENTS

2008/0314356 A1* 12/2008 Kamen ..... F16C 11/12
123/197.3
2012/0090571 A1* 4/2012 Namikoshi ..... F01B 1/08
123/193.6

FOREIGN PATENT DOCUMENTS

GB 755255 A 8/1956
WO 2014011122 A1 1/2014

* cited by examiner

INTERNAL COMBUSTION ENGINE

FIELD OF THE INVENTION

The invention belongs to the field of movement conversion systems capable of generating a continuous circular movement from a reciprocating rectilinear movement, and it relates more particularly to an engine, in particular of the type known as an internal combustion engine.

PRIOR ART

A reciprocating rectilinear movement is converted into a continuous circular movement by means of a mechanism referred to as a connecting rod-crank mechanism. This mechanism is generally used in internal combustion engines to deliver a torque capable of moving a vehicle.

Typically, an internal combustion engine comprises a crankshaft having one or more crank pins, the or each crank pin forming a crank about which a connecting rod pivots by one of its ends, called the big end. At its other end, called the small end, the connecting rod is hinged to a piston fitted slidably in a cylinder. The piston forms, with the cylinder, a working chamber inside the cylinder called a "combustion chamber", in which the combustion of a mixture of gas, such as air, and fuel, such a hydrocarbon, takes place. By causing the mixture to expand, this combustion generates a thrust force on the piston which transmits, via the connecting rod, a portion of this force to the crank pin of the crankshaft, with a view to causing the crankshaft to rotate.

The operating cycle of an internal combustion engine comprises an intake phase in which a mixture of fresh gas and fuel is taken into the combustion chamber of the or each cylinder, followed by a phase of compression of this mixture by the or each piston, then respective phases of combustion of the mixture, generating an increase in the pressure in the combustion chamber, and expansion of the burnt gases, and finally an exhaust phase for discharge of the burnt gases.

The stroke of the piston in the cylinder is bounded by two end positions, namely top dead center, at which the volume of the combustion chamber is at a minimum, and bottom dead center, at which the volume of the combustion chamber is at a maximum.

One of the disadvantages of the prior art internal combustion engines is their low efficiency. Efficiency means the ratio between the mechanical power supplied by the crankshaft and the power supplied by the fuel required for combustion of the gas and fuel mixture.

The poor efficiency of prior art internal combustion engines is due in particular to friction generated by the many moving parts making up the drive train of these engines.

This friction is in part generated by the stroke of the piston along the cylinder. To be specific, during the piston stroke, the connecting rod makes an angle with the axis of a generatrix of the cylinder, which varies depending on the angular position of the crank pin, this being referred to as obliquity of the connecting rod. This obliquity reaches a maximum value when the piston is halfway between top dead center and bottom dead center. Owing to the relatively high value of this angle, the piston generates transverse forces, that is to say forces perpendicular to the longitudinal axis of the cylinder, as it slides along the cylinder. Furthermore, in addition to generating friction which can cause premature wear of the moving parts, these forces can generate mechanical fatigue of the crankshaft under the action of cyclic mechanical stress, and therefore lead to a rupture of the crankshaft.

The obliquity of the connecting rod also causes sharp accelerations and decelerations of the piston as it travels between top dead center and bottom dead center, and vice versa. These sharp accelerations and decelerations generate "second-order" inertial forces. These second-order forces vary twice every crankshaft revolution and can cause the onset of significant internal mechanical stresses in the moving components of the engine.

The poor efficiency of internal combustion engines is also due to the fact that the combustion of the gas and fuel mixture is incomplete. Indeed, due to incomplete combustion, the power that can be potentially supplied by the fuel in the combustion chamber is not fully exploited.

The fact that combustion is incomplete is attributable mainly to the insufficient duration of the compression and combustion phases. To be specific, the piston does not remain in the vicinity of top dead center long enough to maintain the mixture at a high compression for long enough to ensure substantially complete combustion. Indeed, because of the structure of the connecting rod/crank mechanism of prior art engines, the rotation of the connecting rod about the crank pin of the crankshaft subjects the piston to a strong linear acceleration immediately after reaching top dead center.

For example, when the piston is in the vicinity of top dead center, the piston is driven to compress the mixture at between ninety and one hundred percent of the maximum pressure of the mixture for a rotation of five to ten degrees of the crankshaft. The maximum pressure of the mixture is reached when the piston is at top dead center.

The fact that combustion is incomplete also generates a problem in terms of air pollution insofar as unburned gases are released during the exhaust phase. These unburned gases are moreover harmful to human health.

Furthermore, the pistons of prior art internal combustion engines are subjected to sharp acceleration and deceleration cycles. Therefore, the pistons generate inertial forces acting cyclically on the crankshaft. In addition to mechanical fatigue suffered by these parts, these cyclic stresses generate vibration which may cause the parts to break.

Another drawback of the prior art internal combustion engines lies in their high weight, due to the large number of parts they include. The result of this weight is, in particular, that it requires considerable power to move the vehicle comprising the engine, thus leading to a high consumption of fuel. Furthermore, the fact that internal combustion engines are heavy complicates maintenance.

DISCLOSURE OF THE INVENTION

The present invention aims to overcome the aforementioned disadvantages by providing an internal combustion engine that is highly efficient, lightweight and compact.

The present invention concerns in particular, in a first aspect, an internal combustion engine comprising at least two cylinders with parallel longitudinal axes, each cylinder comprising an opening and a piston capable of moving in translation inside said cylinder, said respective openings in said cylinders facing one another, said pistons being in kinematic relation with a connecting rod/crank mechanism comprising:

- a spacer connecting said pistons, adapted to maintain a fixed spacing between said pistons, such that a translational movement of one piston causes the other piston to perform the same translational movement, said pistons being respectively attached to arms of said spacer, a crankshaft rotatably mounted about an axis, arranged between the openings in the cylinders and between the longitudinal axes of said cylinders, said crankshaft comprising a crank pin, a rocker rotatably mounted about the crank pin, comprising two ends arranged on either side of said crank pin, at least one connecting rod comprising a first end, referred to as the "small end", secured to the spacer, and a second end, referred to as the "big end", secured to one of the ends of the rocker.

The term "secured" means "rotatably attached".

By virtue of these features, the guiding in translation of one piston is provided by the other piston. Therefore, the pistons are subjected essentially to axial forces during combustion of the mixture, and generate little or no transverse forces in the cylinders as they slide. The friction generated by the sliding of the pistons in the cylinders is thus negligible compared to the friction generated by the sliding of the pistons in the cylinders of prior art engines. Engine efficiency is thereby substantially increased.

Moreover, the rocker is adapted to describe a reciprocating rotary movement about the crank pin as the pistons move in translation in the cylinders, so as to cause the big end of the connecting rod or rods to describe a non-circular path. Thus, speed of arrival and departure of each piston at top dead center is relatively low compared to prior art engines, such that the period during which each piston moves in the vicinity of top dead center is relatively long compared to prior art engines. For example, when the piston is in the vicinity of top dead center, the piston is driven to compress the mixture at between ninety and one hundred percent of the maximum pressure of the mixture for a rotation of approximately twenty-five degrees of the crankshaft.

Thus, the piston maintains high pressure in the combustion chamber long enough for combustion to be substantially complete. Consequently, the exhaust gases no longer include (or include only an insignificant amount of) unburned gases, which are a source of air pollution and harmful to human health. By way of example, the combustion phase is performed during a rotation of approximately one hundred twenty degrees of the crankshaft.

The substantially complete combustion also leads to a gain in engine efficiency, and therefore a reduction in fuel consumption. At equal power, the amount of fuel required for operation of the engine is less for the internal combustion engine according to the invention than for an internal combustion engine of the prior art. For example, at equal power and under the same operating conditions, the fuel consumption of the engine according to the invention is over 60% lower than the fuel consumption of a prior art engine.

In particular embodiments, the invention also has the following features, implemented separately or in each technically functioning combination thereof.

In particular embodiments of the invention, the arms of the spacer are connected to a spacer body including an opening through which the crankshaft is capable of moving.

By virtue of these features, the spacer is more rigid and is therefore better able to return the forces transmitted by the pistons during the phase of combustion of the mixture. Furthermore, the spacer is better able to withstand the mechanical stresses resulting from these forces.

The journals or the crank pin of the crankshaft can move through the opening in the spacer, depending on the configuration of said opening.

In particular embodiments, the internal combustion engine comprises two connecting rods, respectively secured to the spacer by their small end, and respectively secured to one of the ends of the rocker by their big end.

The connecting rod small ends may be respectively secured to the arms or body of the spacer, preferably at two respective points substantially diametrically opposite one another relative to the axis of rotation of the journals of the crankshaft.

In particular embodiments of the invention, the internal combustion engine comprises four cylinders arranged in pairs, arranged symmetrically on either side of a median plane P containing the axis of rotation of the crankshaft, so that the longitudinal axis of the cylinders is perpendicular to the plane P.

In particular embodiments of the invention, the spacer comprises four arms distributed in two pairs connected on either side of a spacer body.

In particular embodiments of the invention, the internal combustion engine comprises two rockers rotatably mounted about the crank pin, a connecting rod being secured by its big end to at least one of the ends of each rocker.

According to other features, the internal combustion engine comprises four connecting rods, respectively secured to one of the arms of the spacer by their small end, and respectively secured to one of the ends of the rockers by their big end.

According to another embodiment of the invention, the internal combustion engine comprises a plurality of sets of four cylinders juxtaposed with one another along the axis of rotation of the crankshaft, in such a way that the pistons of each set of four cylinders are in kinematic relation with the same crankshaft.

In its various aspects, the internal combustion engine according to the invention has the particular advantage of having, at equal power, smaller dimensions and a lower weight owing to the arrangement of the cylinders and the short length of the crankshaft. For example, at equal power, the combustion engine according to the invention has a weight and a volume about three times lower than a prior art engine.

PRESENTATION OF THE FIGURES

Figure 2:
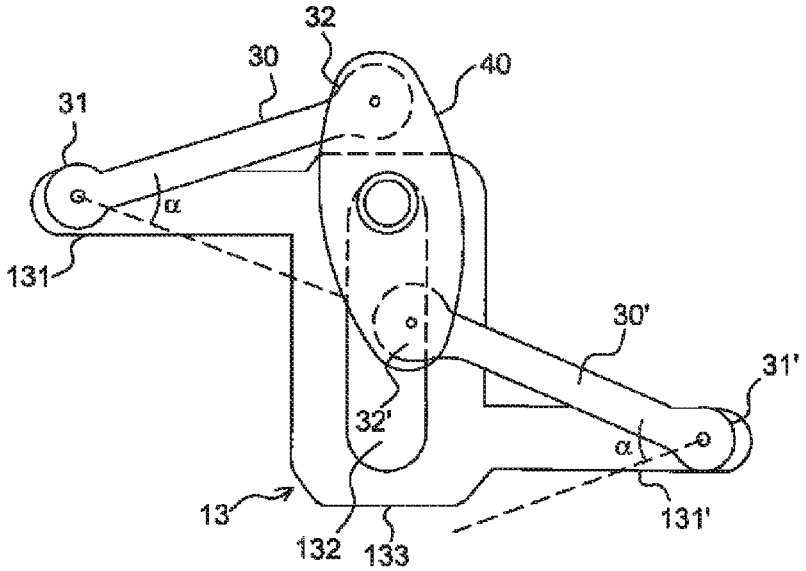
Figure 3:
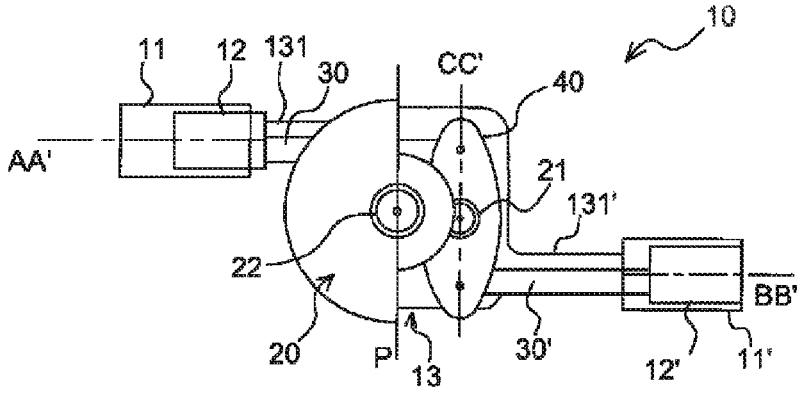
Figure 4:
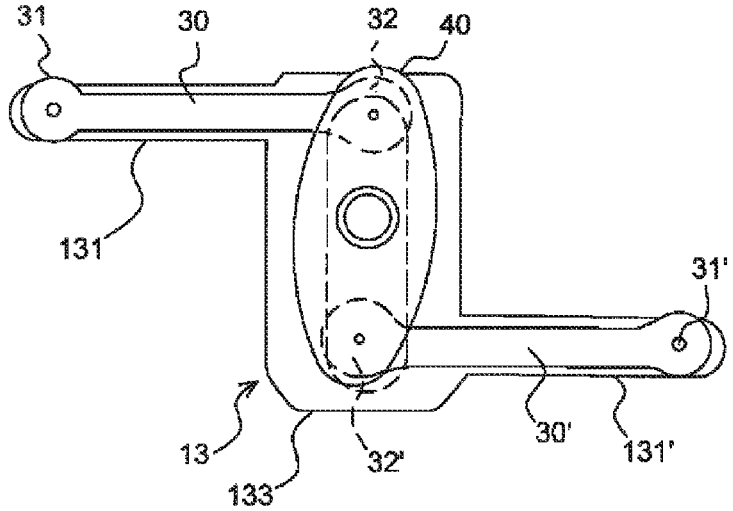
Figure 5:
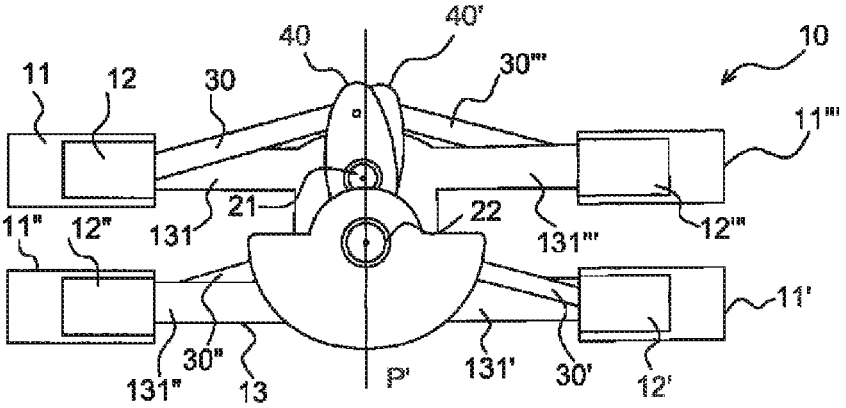
Figure 6:
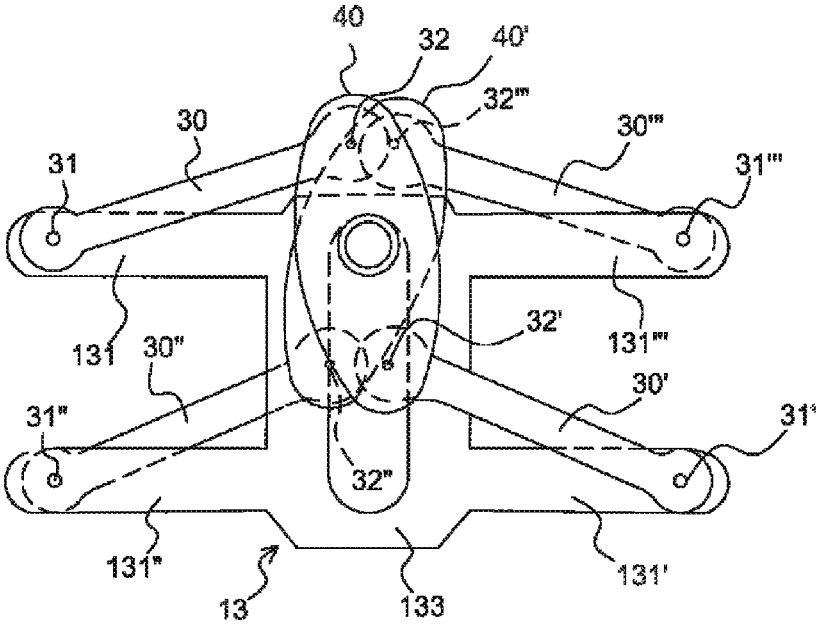
Figure 7:
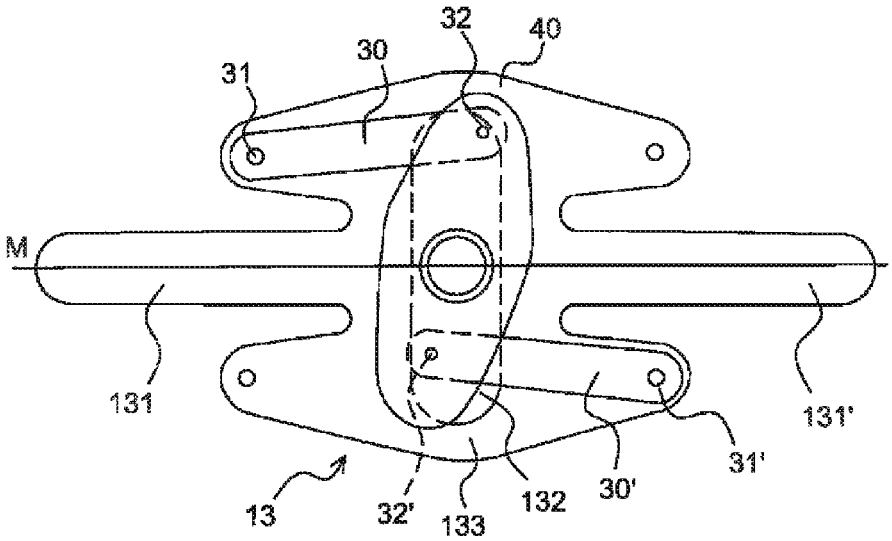
Figure 8:
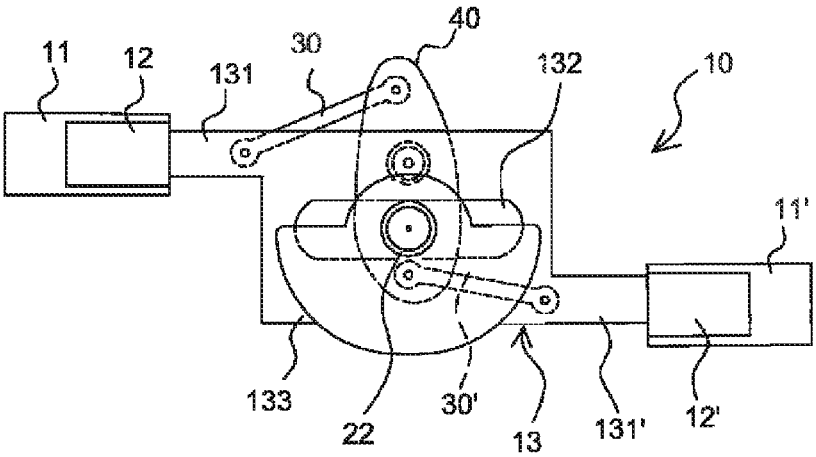

A clearer understanding of the invention will be gained by reading the following description, provided by way of non-limiting example and with reference to the figures, which show:

FIG. 1: a schematic view of a first embodiment of an internal combustion engine, the pistons being mid-stroke, FIG. 2: a view of some elements separated from the internal combustion engine according to FIG. 1, FIG. 3: a schematic view of the internal combustion engine according to FIG. 1, the pistons being in an end position, FIG. 4: a view of some elements separated from the internal combustion engine according to FIG. 3, FIG. 5: a schematic view of an internal combustion engine according to a second embodiment of the invention, the pistons being mid-stroke, FIG. 6: a view of some elements separated from the internal combustion engine according to FIG. 5, FIG. 7: a schematic view of a connecting rod/crank mechanism of an internal combustion engine according to a third embodiment of the invention, FIG. 8: a schematic view of an exemplary embodiment of a connecting rod/crank mechanism of an internal combustion engine according to the invention.

DETAILED DESCRIPTION OF THE INVENTION

The present invention relates to an internal combustion engine 10 comprising cylinders in each of which a piston is slidably engaged, so as to form a combustion chamber, known to a person skilled in the art. The pistons are in kinematic relation with a connecting rod/crank mechanism for transmitting a torque capable of driving, for example, a moving vehicle.

In a first embodiment of the invention, as shown in FIGS. 1 to 4, the internal combustion engine 10 comprises two cylinders 11, 11' lying along two parallel longitudinal axes AA' and BB', respectively, and each including an opening. The cylinders 11, 11' are not coaxial and are preferably arranged on either side of, and at a distance from, a median plane P, such that the longitudinal axes AA' and BB' are perpendicular to the median plane P and such that their openings face one another.

Each cylinder 11, 11' is adapted to receive a piston 12, 12' slidably engaged, through its opening, between two end positions, respectively called "top dead center" and "bottom dead center".

In the first embodiment of the invention, the connecting rod/crank mechanism comprises a spacer 13 connecting the pistons 12 and 12', and to which said pistons 12 and 12' are rigidly attached. The spacer 13 is adapted to maintain a fixed spacing between the two pistons 12, 12', such that the translational movement of one piston 12 or 12' results in a similar movement of the other piston. Thus, as shown in FIG. 3, when a piston 12' is at top dead center, the other piston 12 is at bottom dead center, and vice versa.

As shown in FIGS. 2 and 4, the spacer 13 comprises two arms 131, 131', which are for example parallel. The arms 131, 131' of the spacer 13 extend between a first end, referred to as the proximal end, via which the arms 131, 131' are connected to either side of a spacer 13 body 133, and a second end, referred to as the distal end, at a distance from the body 133, to which a piston 12, 12' is attached. Preferably, each piston 12 and 12' is attached to an arm 131 and 131' with degrees of freedom in rotation, for example along axes perpendicular to the longitudinal axes of the arms, so as to correct any defects of parallelism between the cylinders.

It should be noted that, in FIGS. 2 and 4, the pistons are not shown. As shown in FIGS. 1 and 3, the distal end of each arm 131, 131' is adapted to be engaged in a cylinder, with the piston 12, 12' to which it is attached.

The connecting rod/crank mechanism also comprises a crankshaft 20 with a crank pin 21 interposed between two journals 22, and at least one balancing weight 23 known to a person skilled in the art. The journals 22 are rotatably mounted, for example, in bearings known per se.

In the non-limiting example shown in FIG. 2, the body 133 of the spacer 13 is provided with an opening 132 configured to receive the crank pin 21, and through which said crank pin 21 is adapted to move, when, for example, the crankshaft 20 rotates. The opening lies for example along a longitudinal axis perpendicular to the longitudinal axes AA' and BB of the cylinders 11 and 11', respectively.

Alternatively, the body 133 of the spacer 13 may be configured such that it does not include an opening.

Preferably, the axis of rotation of the journals 22 of the crankshaft 20 is inscribed in the median plane P, and said axis is located equidistant from each of the longitudinal axes AA' and BB of the cylinders 11 and 11', respectively.

The connecting rod/crank mechanism also comprises at least one connecting rod 30 which is secured, by one of its ends referred to as the "small end" 31, to the distal end of one of the arms 131 or 131', and by its other end, referred to as the "big end" 32, to a rocker 40.

In other embodiments, the connecting rod 30 may also be secured by its small end 31 to any point along the arms 131 or 131'. This arrangement advantageously makes it possible to dimension the length of the connecting rod optimally so as to limit second-order inertial forces.

In the non-limiting embodiment shown in FIGS. 1 to 4, the connecting rod/crank mechanism comprises two connecting rods 30 and 30' respectively secured by their small end 31 or 31' to the distal end of one of the arms 131 or 131', and by their big end 32 or 32' to a rocker 40. Preferably, the connecting rod small ends 31 and 31' are secured to the arms 131 and 131' at two respective points substantially diametrically opposite one another relative to the axis of rotation of the journals 22.

As schematically shown in FIGS. 1 to 4, the rocker 40 comprises a central opening via which it is rotatably mounted about the crank pin 21, for example by means of a smooth bearing known per se. The center of the rocker 40 is defined as the point about which any point on the periphery of the rocker has a symmetrical point.

The rocker 40 lies along a longitudinal axis CC' and has two ends on either side of the crank pin 21.

Preferably, each of the ends of the rocker 40 is secured to a connecting rod big end 32, 32', by means known per se, such as a shaft mounted in bores made respectively in the big ends 32, 32' of the connecting rods 30, 30' and in the ends of the rocker 40.

The rocker 40 is adapted to cause each connecting rod big end 32, 32' to describe a path different to the circular path described by the crank pin 21 of the crankshaft during operation of the internal combustion engine 10. Advantageously, the rocker 40 causes each connecting rod big end 32 to describe a substantially non-circular path.

The connecting rods 32 and 32' and the rocker 40 are dimensioned such that when the pistons are halfway, the connecting rods 30 and 30' are substantially parallel.

During the operating cycle of the internal combustion engine 10 according to the present invention, when a combustion is generated in the combustion chamber of a cylinder 11 or 11', a thrust force is produced on a piston 12 or 12' slidably arranged in said cylinder. Said piston then transmits, by means of the spacer 13, a portion of this force to the connecting rods 30 and 30'. The connecting rods 30 and 30' transmit these forces to the respective ends of the rocker 40 to which they are secured, creating a moment of force causing rotation of said rocker 40 about the crank pin 21, and in fact causing rotation of the crank pin 21 about the axis of rotation of the journals 22. It should be noted that the forces applied by the connecting rods on the rocker are characterized, for one of the connecting rods, by a traction force on the rocker 40 and, for the other, by a thrust force on the rocker 40.

The distance between the center of the rocker 40 and the axis of rotation of each connecting rod big end 32 on the rocker 40 represents a lever arm. Therefore, the intensity of the moment of force generated on the end of the rocker 40 is proportional to the length of this distance.

These arrangements make it possible to reduce the dimensions of the cylinders 11, 11' and of the pistons 12, 12', while allowing the crank shaft to deliver a relatively high torque. For a torque of given value delivered by the crankshaft, the dimensions of the pistons and cylinders of the engine 10 according to the present invention are therefore smaller than in prior art engines.

Since the two pistons 12 and 12' are kinematically linked to one another by virtue of the spacer 13, the thrust force produced on one of the pistons 12 or 12', during the combustion, is also partially transmitted to the other piston 12 or 12'. The axial guiding of one of the pistons 12 or 12', as it slides in the cylinder 11 or 11' with which it is associated, is provided by the sliding of the other piston 12 or 12' in the cylinder 11 or 11' with which it is associated. Therefore, the pistons 12 and 12' are subjected essentially to axial forces and generate little or no transverse forces in the cylinders 11, 11' as they slide. This arrangement advantageously makes it possible to significantly reduce second-order inertial forces.

When the pistons 12 and 12' move between top and bottom dead center, and vice versa, the forces of the connecting rods 30 and 30' on the rocker 40 cause said rocker 40 to describe substantially a circular translational movement about the axis of rotation of the journals 22.

When a piston 12 or 12' moves from one of its end positions to the other, the connecting rod 30 or 30' secured to the arm 131 or 131' to which said piston 12 or 12' is attached, pivots about its small end 31 or 31', between two angular end positions, as shown in broken lines in FIG. 2. Each connecting rod 31 and 31' is adapted such that its big end 32 or 32' describes, during an engine operating cycle, an arc of a circle of angle $\alpha$.

When the pistons 12 and 12' are each halfway between the top dead center and bottom dead center positions, the longitudinal axis CC' of the rocker 40 makes an angle $\beta$ with the median plane P, as shown schematically in FIG. 1. Furthermore, when the pistons 12 and 12' are in the top dead center and bottom dead center positions, the longitudinal axis CC' is parallel to the median plane P, as shown in FIG. 3.

The rocker 40 is thus subjected, during the movement of the pistons 12 and 12' between their two end positions, to a reciprocating rotary movement about the crank pin 21 by an angle $\beta$ relative to the median plane P.

The rocker 40 thus describes a movement composed of a circular translation about the axis of rotation of the journals 22 and a reciprocating rotation about the crank pin 21.

This reciprocating rotation advantageously allows the pistons 12 and 12' to stay in the vicinity of top and bottom dead center for a maximum length of time.

Thus, during operation of the internal combustion engine 10, when the piston 12 or 12' is at top dead center, a high pressure, close to the maximum pressure of the mixture, is maintained by said piston 12 or 12' for longer than in a prior art engine. High pressure, close to the maximum pressure of the mixture, means a pressure between ninety and one hundred percent of the maximum pressure. The maximum pressure of the mixture is the pressure of the mixture when the piston 12 or 12' is at top dead center. The time for which a high pressure is applied to the mixture represents rotation of the crankshaft by approximately twenty-five degrees.

Advantageously, the high pressure is maintained in the combustion chamber by said piston long enough to obtain substantially complete combustion of the mixture during the combustion phase.

Moreover, this reciprocating rotation of the rocker 40 makes it possible in particular to greatly limit the acceleration of the piston 12, 12' due to the obliquity of the connecting rods.

In a second embodiment, as shown schematically in FIGS. 5 and 6, the internal combustion engine 10 has four pistons 12, 12', 12" and 12''' slidably engaged, respectively, in four cylinders 11, 11', 11" and 11''', each comprising an opening. Said cylinders are arranged in pairs, on either side of a median plane P', the longitudinal axis of the cylinders 11, 11', 11" and 11''' being perpendicular to this plane P'. Preferably, said cylinders are arranged symmetrically on either side of, and at a distance from, the median plane P', such that the cylinders 11, 11" of one pair are coaxial with respect to the cylinders 11', 11''' of the other pair, and such that the openings in said cylinders 11, 11" are arranged opposite the openings in the cylinders 11', 11'''.

The internal combustion engine 10 according to the second embodiment has a connecting rod/crank mechanism similar to that of the first embodiment, except for the number of cylinders, and therefore the number of pistons, spacer arms and connecting rods.

Preferably, for reasons of balance of masses in movement, the axis of rotation of the journals 22 of the crankshaft 20 is located equidistant from all of the cylinders 11, 11', 11" and 11''', for example, inscribed within the plane P'.

The four pistons 12, 12', 12" and 12''' are kinematically linked to one another via the spacer 13, such that the movement of two pistons 12 and 12", or 12' and 12''', of one pair results in a similar movement of the pistons 12 and 12", or 12' and 12''', of the other pair.

As in the first embodiment, the pairs of pistons 12 and 12", 12' and 12''' are attached to the spacer 13 by means of pairs of arms 131 and 131', 131" and 131''' of the spacer 13 connected to the spacer body 133, as shown in FIG. 6. It should be noted that the pistons are not shown in FIG. 6. The pairs of arms are connected respectively on either side of the spacer body 133 such that the longitudinal axis of one arm 131 or 131' of a pair coincides with the longitudinal axis of an arm 131" or 131''' of the other pair. Preferably, the longitudinal axes of the arms 131, 131', 131" and 131''' coincide with the longitudinal axes of the cylinders 11, 11', 11" and 11''', respectively.

As shown schematically in FIG. 6, the small end 31, 31', 31" and 31''' of a connecting rod 30, 30', 30" and 30''' is respectively secured to each distal end of the spacer arms 131, 131', 131" and 131'''. Said connecting rods 30 and 30' are respectively secured by their big end 32, 32' to a rocker 40 and said connecting rods 30" and 30''' are respectively secured by their big end 32", 32''' to a second rocker 40'. Alternatively, each rocker 40, 40' may be secured to a single connecting rod 30 or 30', and 30" or 30''', respectively. Two pairs of connecting rods are respectively formed by the connecting rods 30 and 30' and the connecting rods 30" and 30'''.

Advantageously, the connecting rods 30 and 30', and 30" and 30''' of each pair are diagonally opposite, as shown in FIGS. 5 and 6. The term "diagonally opposite" means that the connecting rods of each pair of connecting rods are respectively associated with the arms of each pair of arms, and that the respective longitudinal axes of the arms with which the connecting rods of the same pair are associated are spaced apart from one another.

In this embodiment of the invention, two rockers 40 and 40' are rotatably mounted about the crank pin 21. The rockers 40 and 40' are arranged, for example, on either side of the spacer 13, on the crank pin 21.

Thus, when the pistons 12, 12', 12" and 12''' move between top and bottom dead center, and vice versa, the forces of the connecting rods 30, 30', 30" and 30''' on each of the rockers 40 and 40' cause each said rocker to describe substantially a circular translational movement about the axis of rotation of the journals 22.

However, since each rocker 40 and 40' is respectively associated with a pair of diagonally opposite connecting rods 30 and 30', and 30" and 30'", the rockers 40 and 40' are caused to describe, about the crank pin 21, a reciprocating rotary movement, inverted relative to one another. In other words, the rotational movement of one of the rockers 40 or 40' is symmetrical to the rotational movement of the other rocker 40 or 40' about a plane of symmetry parallel to the plane P'. The angle made by the longitudinal axis of one of the rockers 40 or 40' with the plane P is opposite to the angle made by the longitudinal axis of the other rocker 40 or 40' with said plane P, with respect this plane P.

Thus, just as for the first embodiment, this reciprocating rotary movement allows the connecting rod big ends 32, 32', 32" and 32'" to describe a non-circular path during operation of the internal combustion engine 10, that is to say, upon rotation of the rockers 40 and 40' about the axis of rotation of the journals 22.

Therefore, during the strokes of the pistons 12, 12', 12" and 12'" in the cylinders 11, 11', 11" and 11'", respectively, said pistons remain at top dead center long enough for a high pressure to be maintained by the piston within the combustion chamber long enough to obtain substantially complete combustion of the mixture.

Advantageously, a combustion may be effected concomitantly in the combustion chamber of each cylinder 11 and 11", or 11' and 11'", of the same pair. The thrust forces produced by combustion are transmitted by the pistons 12 and 12', or 12" and 12'" respectively engaged in the cylinders 11 and 11", or 11' and 11'" of said pair to other pistons 12 and 12', or 12" and 12'" and include only an axial component. The axial guiding of a piston as it slides in the cylinder with which it is associated, is provided by the sliding of the other pistons in the respective cylinders with which they are associated. The pistons therefore do not generate transverse forces. This arrangement advantageously makes it possible to significantly reduce second-order inertial forces.

In a third embodiment of the invention, the internal combustion engine 10 comprises two cylinders according to the first embodiment described above, except that they are coaxial. As in the other embodiments of the invention, a piston is slidably engaged in each cylinder.

The internal combustion engine 10 according to the third embodiment comprises a connecting rod/crank mechanism as shown in FIG. 7, identical to that of the first embodiment, except for the configuration of the spacer 13.

More specifically, as in the first embodiment, the pistons are kinematically linked to one another by virtue of the arms 131 and 131' of the spacer 13. However, in this embodiment of the invention, the arms 131 and 131' are coaxial and are arranged on either side of the spacer body 133. Preferably, the longitudinal axes of the arms 131 and 131' and the axis of rotation of the journals 22 of the crankshaft 20 are inscribed in the same plane M. This plane M is for example a median plane of the spacer 13.

The small ends 31 and 31' of the connecting rods 30 and 30' are respectively secured to the spacer body 133 at two points substantially diametrically opposite one another relative to the axis of rotation of the journals 22. The connecting rods 30 and 30' are respectively secured by their big end 32 and 32' to each end of the rocker 40.

Alternatively, a first and a second rocker 40 and 40' may be arranged on either side of the spacer 13 and arranged to rotate about the crank pin 21. The internal combustion engine 10 thus comprises two pairs of connecting rods, each connecting rod pair being secured to a rocker as described above.

In another embodiment of the connecting rod/crank mechanism as shown in FIG. 8, which may be implemented in the embodiments of the invention described above, the spacer 13 has an opening 132 configured such that the journals 22 of the crankshaft 20 are adapted to move through said opening 132 during the sliding of said spacer 13. The opening 132 preferably lies along a longitudinal axis parallel to the respective longitudinal axes AA' and BB' of the cylinders 11 and 11'. The spacer 13 comprises arms 131, 131' in accordance with one of the embodiments described above, connected to either side of the spacer body 133, and at the end of each of which a piston 12 or 12' is attached.

The connecting rod/crank mechanism also includes, for example, two connecting rods 30, 30' respectively secured by their small end 31, 31' to the arms 131, 131' or to the body 133, and by their big end 32, 32' to the rocker 40.

Thus, as for the operating cycle of the internal combustion engine 10 described above, when a combustion is generated in the combustion chamber of a cylinder 11 or 11', a thrust force is produced on a piston 12 or 12' slidably arranged in said cylinder. Said piston then transmits, by means of the spacer 13, a portion of this force to the connecting rods 30, 30'. The connecting rods 30, 30' transmit this force to the ends of the rocker 40 to which they are respectively secured, creating a moment of force causing rotation of said rocker 40 about the crank pin 21, and in fact causing rotation of the crank pin 21 about the axis of rotation of the journals 22.

In the same manner as in the embodiments described above, one of the connecting rods 30 or 30' exerts a traction force on the rocker 40, and the other exerts a thrust force on the rocker 40.

In other embodiments of the invention, not shown in the figures, the internal combustion engine 10 may include more or fewer cylinders than the engine according to the embodiments of the invention described above. The number of pistons is the same as the number of cylinders.

In other embodiments of the invention, the internal combustion engine 10 includes sets of two or four cylinders in series, juxtaposed with one another along the axis of rotation of the journals, and sharing a single crankshaft. The internal combustion engine 10 preferably comprises two sets of two or four cylinders, each set of cylinders being associated with pistons in kinematic relation with a connecting rod/crank mechanism according to one of the embodiments of the invention described above. More specifically, the crankshaft includes two crank pins arranged, for example, at one hundred eighty degrees relative to one another, on each of which one or two rockers are rotatably fitted. It should be noted that a rocker is preferably secured to two connecting rods, and is thus associated with two pistons. Therefore, the number of rockers is equal to half the number of cylinders.

More generally, it should be noted that the embodiments discussed above have been described as non-limiting examples, and that other variants are therefore possible.

In particular, there is nothing to preclude combining, according to other examples, the various features of the various embodiments of the invention.

Furthermore, the connecting rod/crank mechanism has been described in connection with a combustion engine, but may be used in an engine operating with other types of energy, such as a pressurized fluid.

The invention claimed is:

1. An internal combustion engine comprising at least two cylinders with parallel longitudinal axes, each cylinder comprising an opening and a piston capable of moving in translation inside said cylinder, said respective openings in said cylinders facing one another, said pistons being in kinematic relation with a connecting rod/crank mechanism, characterized in that said connecting rod/crank mechanism comprises:

a spacer connecting said pistons, adapted to maintain a fixed spacing between said pistons, such that a translational movement of one piston causes the other piston to perform the same translational movement, said pistons being respectively attached to arms of said spacer, a crankshaft rotatably mounted about an axis, arranged between the openings in the cylinders and between the longitudinal axes of said cylinders, said crankshaft comprising a crank pin, a rocker rotatably mounted about the crank pin, comprising two ends arranged on either side of said crank pin, at least one connecting rod comprising a first end, being a small end, secured to the spacer, and a second end, being a big end, secured to one of the ends of the rocker.

2. The internal combustion engine as claimed in claim 1, in which the arms of the spacer are connected to a spacer body including an opening through which the crankshaft is capable of moving.

3. The internal combustion engine as claimed in claim 1, comprising two connecting rods, respectively secured to the spacer by their small end, and respectively secured to one of the ends of the rocker by their big end.

4. The internal combustion engine as claimed in claim 1, comprising four cylinders arranged in pairs, arranged symmetrically on either side of a median plane P in which the axis of rotation of the crankshaft is inscribed, so that the longitudinal axis of the cylinders is perpendicular to the plane P.

5. The internal combustion engine as claimed in claim 4, in which the spacer comprises four arms distributed in two pairs connected on either side of a spacer body.

6. The internal combustion engine as claimed in claim 4, comprising two rockers rotatably mounted about the crank pin, a connecting rod being secured by its big end to at least one of the ends of each rocker.

7. The internal combustion engine as claimed in claim 4, comprising four connecting rods, respectively secured to one of the arms of the spacer by their small end, and respectively secured to one of the ends of the rockers by their big end.

8. The internal combustion engine as claimed in claim 4, comprising a plurality of sets of four cylinders juxtaposed with one another along the axis of rotation of the crankshaft, in such a way that the pistons of each set of four cylinders are in kinematic relation with the same crankshaft.

* * * * *